US010022753B2

(12) United States Patent
Chelian et al.

(10) Patent No.: US 10,022,753 B2
(45) Date of Patent: Jul. 17, 2018

(54) AUTOMATED MAILBOX

(71) Applicant: Toyota Motor Engineering & Manufacturing North America, Inc., Erlanger, KY (US)

(72) Inventors: Suhas E. Chelian, San Jose, CA (US); Allison Thackston, San Jose, CA (US); Douglas Moore, Livermore, CA (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 98 days.

(21) Appl. No.: 15/153,406

(22) Filed: May 12, 2016

(65) Prior Publication Data

US 2017/0326598 A1 Nov. 16, 2017

(51) Int. Cl.

| | |
|---|---|
| ***B07C 5/36*** | (2006.01) |
| ***A47G 29/12*** | (2006.01) |
| ***B07C 5/38*** | (2006.01) |

(52) U.S. Cl.

CPC ..... *B07C 5/362* (2013.01); *A47G 29/1216* (2013.01); *B07C 5/38* (2013.01)

(58) Field of Classification Search

USPC ..... 700/223

See application file for complete search history.

(56) References Cited

U.S. PATENT DOCUMENTS

| | | | |
|---|---|---|---|
| 7,261,511 | B2 | 8/2007 | Felder et al. |
| 7,381,026 | B1 | 6/2008 | Power et al. |
| 7,960,668 | B2 | 6/2011 | Fethke et al. |
| 8,238,602 | B2 | 8/2012 | Manuel-Devadoss |
| 2007/0233507 | A1 | 10/2007 | Publicover |
| 2015/0006005 | A1 | 1/2015 | Yu |
| 2015/0112885 | A1 | 4/2015 | Fadell et al. |
| 2015/0317597 | A1 | 11/2015 | Shucker et al. |

FOREIGN PATENT DOCUMENTS

| | | |
|---|---|---|
| JP | 20032100310 | 7/2003 |
| WO | WO 2015177760 | 11/2015 |

OTHER PUBLICATIONS

Wright, Kim; "RoboPost"; https://sites.google.com/kimwrightaerospace/robopost; 1 page.

"Standardised Mailboxes for Robotic Mail Delivery"; 3 pages; 2014.

"Self-Driving Delivery Robot"; Starship Technologies; 3 pages; 2015.

Clifton et al; "Automated Mailbox"; Iowa State University; 47 pages; May 2, 2007.

"Mailmobile Automatic Mail Delivery AGVs"; Egemin Automation Inc.; www.egeminusa.com/pages/agvs/agvs_mailmobile.html; 1 page.

*Primary Examiner* — Kyle O Logan

(74) *Attorney, Agent, or Firm* — Snell & Wilmer LLP

(57) ABSTRACT

Methods, systems, and apparatus for an automated mailbox system. The automated mailbox system includes a personal device configured to manage a robot. The robot includes a base that forms a foundation for the robot and is coupled to a post. The robot includes a mailbox having a door. The mailbox is configured to receive documents when in the open position. The robot includes a transportation component that moves the robot in multiple directions among multiple locations. The transportation component is configured to move the robot in a first direction to a first location.

19 Claims, 6 Drawing Sheets

AUTOMATED MAILBOX

BACKGROUND

1. Field

This specification relates to an automatic mailbox robot that automatically sorts, shreds and delivers mail.

2. Description of the Related Art

Businesses, apartments and residences receive large amounts of personal, business and junk mail on a daily basis. Some residents do not have easy access to their mailbox. For example, in rural areas, the mailbox is often located near the main road but the residence may be secluded or far away from the main road. Other obstacles, such as weather or incapacity, may further hinder easy access to the mailbox. For example, a handicapped individual may not have the ability to walk back and forth to a curbside mailbox to retrieve and/or send mail on a regular basis. Additionally, occupants or residents may not have the time or find it tedious to sort through and shred the junk mail.

Accordingly, there is a need for a system and method that automatically sorts, shreds and delivers mail.

SUMMARY

In general, one aspect of the subject matter described in this specification is embodied in an automated mailbox system. The automated mailbox system includes a personal device connected to a network and configured to manage a robot. The robot includes a base that forms a foundation for the robot and is coupled to a post. The robot includes a mailbox connected to the post and having a door that is configured to move between an open position and a closed position. The mailbox is configured to receive documents when the door is in the open position. The robot includes a transportation component that moves the robot in multiple directions among multiple locations. The transportation component is configured to move the robot in a first direction to a first location.

These and other embodiments may optionally include one or more of the following features. The automated mailbox system may include a power source for providing energy to the robot. The automated mailbox system may include a receptacle assembly configured to interface with the robot and provide energy to charge the power source. The robot may include a navigation unit configured to provide navigation information including a current location. The robot may include a navigation unit that uses a GPS device or one or more ground beacons to navigate. The transportation components may be configured to move in the first direction to the first location based on the mailbox having the first document of the first type in the first bin. The transportation component may be configured to move in a second direction to a second location, and the robot may be configured to connect to the receptacle assembly and receive energy to charge the power source. The transportation component may be configured to move the robot in a third direction to a third location to dispose of a shredded document. The post may vertically extend and retract and may include an anchor that may be configured to secure in a structural member to prevent movement of the robot.

One or more processors may be configured to determine that a first document is in the mailbox and determine that the first document is of a first type. The one or more processors may move the first document to a first bin for the first type. One or more processors may be configured to determine that a second document is in the mailbox and determine that the second document is of a second type. The one or more processors may move the second document to a second bin for the second type and shred the second document in the second bin.

One or more processors may be configured to capture an image of the first document and match one or more features of the first document to one or more attributes of the first type to determine that the first document is of the first type. The one or more processors may be configured to move at least a portion of the first document into the first bin using a letter-sorting device.

In another aspect, the subject matter is embodied in a method for sorting and delivering mail. The method includes obtaining, by an automated mailbox at a first location, one or more pieces of mail, each pieces of mail having a first type and a second type. The method includes, for a respective piece of mail of the one or more pieces of mail, capturing one or more images of the respective piece of mail and determining whether the respective piece of mail is of the first type or the second type. The method includes determining whether the respective piece of mail is of the first type or the second type and determining that at least one piece of mail is in the first bin. The method includes transporting the at least one piece of mail from the first location to a second location.

In another aspect, the subject matter is embodied in a method for sorting and delivering mail. The method includes obtaining a mail request that includes an execution date and an execution time. The method includes obtaining a current date, a current time and a current location. The method includes determining whether the piece of mail is of a first type or a second type and transporting the piece of mail in a first direction toward a first location if or when the piece of mail is of the first type and transporting the piece of mail in a second direction toward a second location if or when the piece of mail is of the second type.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are systems, robots and methods for sorting, shredding and delivering mail. Particular embodiments of the subject matter described in this specification may be implemented to realize one or more of the following advantages. An automated mailbox system automatically retrieves, secures, sorts, shreds and delivers mail. By retrieving mail directly from the mail carrier or sender, the mail is protected until an addressee or mail carrier is able to pick up the mail. For example, the mailbox may have a locking mechanism that prevents the mailbox door from being opened by unauthorized individuals. In another example, the mailbox may be secured to a foundation by an anchor to prevent unauthorized individuals from transporting or stealing the mailbox. Other advantages include the ability to view the contents of the mailbox. This allows a recipient to feel secure that their mail is protected during storage.

Additionally, the automated mailbox system sorts the mail and shreds junk mail, e.g., advertisements, unsolicited mail, or other junk mail. By sorting the mail prior to delivering the mail to the recipient, the automated mailbox system saves the recipient time and effort from having to retrieve and sort through the mail. The automated mailbox system may identify, shred and discard junk mail to also save the recipient time and effort from having to securely dispose of the junk mail.

Other benefits and advantages include the ability to transport the mail between multiple locations, such as the mail delivery location and the mail pickup and/or drop-off location. For example, the mail delivery location may be at the curbside where a mail carrier accesses the mailbox and the mail pickup and drop-off location may be at or near an individual's doorstep to allow easy access of the mailbox. This minimizes the distance an individual, especially those with limited mobility, has to travel to retrieve and send the mail.

Figure 1:
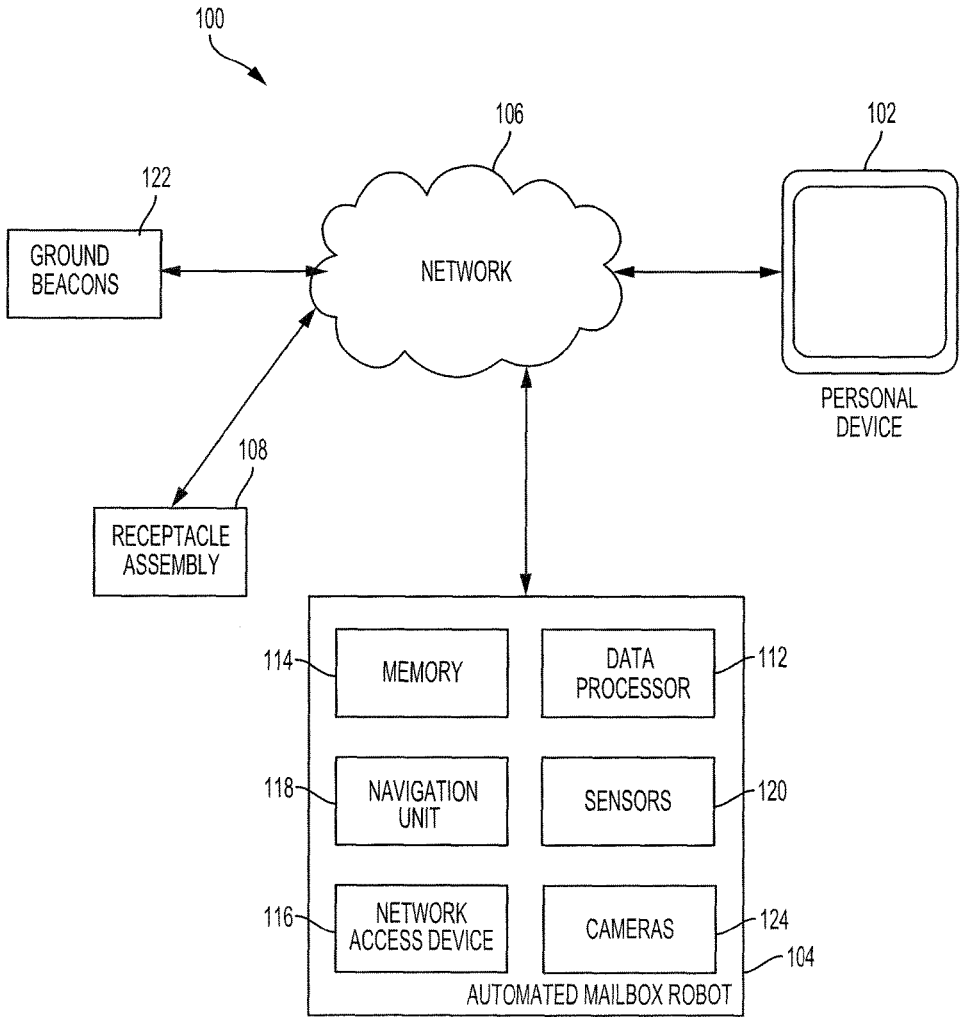
FIG. 1 is a block diagram of an example automated mailbox system according to an aspect of the invention.

FIG. 1 is a block diagram of an example automated mailbox system 100. The automated mailbox system 100 may include one or more robots 104 having one or more data processors 112, appropriately programmed, to execute instructions on a computer storage medium, to organize and deliver the mail to the appropriate recipient.

The automated mailbox system 100 includes one or more computers or processors, e.g., a personal device 102, coupled to one or more robots, e.g., robot 104, through a network 106. The automated mailbox system 100 may include one or more ground beacons 122 connected to the network 106. The network 106, such as a local area network (LAN), a wide area network (WAN), a cellular network, the Internet, a dedicated short-range communications (DSRC) and/or combinations thereof, connects the one or more computers to the one or more robots 104. The network 106 may be a wireless network or a wired network.

The personal device 102, e.g., a smart phone, a cellphone, a personal computer, a tablet, or other communication device of a resident or other occupant of a building, may connect to the robot 104 through the network 106. The personal device 102 may connect to the robot 104 through an application, such as a mobile device application, or through a resource, such as a webpage. The personal device 102 may control and manage the robot 104 through the application or the resource and may function as an input/output device of the robot 104. For example, the personal device 102 may command the robot 104 to deliver mail to the recipient, pick up mail from a sender, display one or more images of the received mail, display monitoring information and/or historical information, shred mail, lock and unlock the mailbox, anchor and/or retract the anchor of the robot 104 and/or perform other functions associated with organizing, sorting, shredding and/or delivering the mail. The personal device 102 may provide operational data to the robot 104 through the network 106 to configure the robot 104. In some implementations, the operational data is programmed at the factory.

Operational data is data that assists the robot 104 to perform the functions of sorting, shredding and/or delivering mail. The operational data may include pre-programmed data to perform functions, such as navigation or setting configurations. The operational data may include navigational information, a schedule, and/or configuration settings. In some implementations, the operational data may be transmitted wirelessly directly from the personal device 102 to the robot 104.

Navigational information describes a route for the robot 104 to travel to transport the mail among one or more locations. For example, the route may direct the robot 104 to remain idle at a first location, such as by the curbside to wait for mail delivery. The robot 104 may receive mail from a mail carrier and travel to a second location, such as the doorstep of a residence to deliver the mail and/or pickup outgoing mail. The robot 104 may then travel to a third location to shred any junk mail. Afterwards, the robot 104 may return to the first location. A mail carrier is any device, vehicle or person who delivers mail. Mail includes, but is not limited to, packages, documents, advertisements, and/or unsolicited mail.

A location may include map coordinates, e.g., latitude and longitude coordinates, or may be a relational location relative to one or more ground beacons. An example relational location may be a location 1 foot left of a first ground beacon and 2 feet right of a second ground beacon. The one or more locations may be user configurable.

Operational information may include a schedule. The schedule may be programmed by a user of the personal device 102. The schedule may describe the location of the robot 104 at a particular time. The route of the robot 104 may be based on the schedule. For example, the robot 104 may be scheduled to idle at the mail delivery location in the afternoon every weekday between 1 p.m. and 4 p.m. because mail is delivered between those times, and in the evenings, the robot 104 may be scheduled to return to the home location to charge and await an indication by a user to deliver the mail to a mail pickup and/or drop-off location. One or more users can be on the schedule for delivery of the mail to the same or different pickup and/or drop-off locations. For example, if three roommates share a house or an apartment, the robot 104 may deliver their respective mail to each of their bedrooms or designated mail delivery location.

The schedule may also describe when to perform one or more additional functions such as a lockdown function. The lockdown function may lock the mailbox during specific scheduled hours and may anchor the robot 104 to a foundation, such as the curbside, by extending a post of the robot 104 into the foundation. For example, "John Doe" may schedule a lockdown of the mailbox when he plans to travel for Christmas week.

Configuration settings may include one or more notification settings for when to send one or more notifications to a user of the personal device 102. Notifications may include an indication that mail has been delivered by the mail carrier, an indication that a piece of mail may be junk mail, an indication that the battery is low on power, an indication that one or more bins has reached a particular capacity, an indication that the robot 104 has been tampered with or is malfunctioning, and/or an indication that the mail has been picked up. The notification may include additional information. The additional information may include a date/time stamp, a captured image of the piece of mail, an image of the inside of the mailbox or the area surrounding the mailbox, capacity information and/or power information.

The automated mailbox system 100 may include a receptacle assembly 108, e.g., an electrical outlet for providing power to the robot 104. The receptacle assembly 108 may charge a battery of the robot 104. The receptacle assembly 108 may be coupled to a power source, such as a solar panel or other power source. The receptacle assembly 108 may have a connector that interfaces with another connector on the robot 104 to charge and/or provide instructions to the robot 104. The connector may be a female connector or a male connector that connects to a corresponding male connector or female connector, respectively, of the robot 104. The connector may include one or more electrical contacts that are made of electrically conductive material, e.g., copper wire, and may electrically connect the receptacle assembly 108 to the robot 104 to charge the robot 104. The personal device 102 may provide operational data to a receptacle assembly 108 through the network 106 to configure the robot 104. In some implementations, the personal device 102 may transmit the operational data directly to the robot 104.

The robot 104 may include a memory 114, one or more data processors 112, a network access device 116, a navigation unit 118 and/or one or more sensors 120. Other components of the robot 104 may be described in further detail in reference to FIG. 2.

The memory 114 may store instructions to execute on the one or more data processors 112 and may include one or more of a RAM or other volatile or non-volatile memory. The memory 114 may be a non-transitory memory or a data storage device, such as a hard disk drive, a solid-state disk drive, a hybrid disk drive, or other appropriate data storage, and may further store machine-readable instructions, which may be loaded and executed by the one or more data processors 112 that may be coupled to the memory 114.

The robot 104 may include one or more data processors 112 coupled to at least one of a navigation unit 118, a network access device 116 and/or one or more sensors 120. The navigation unit 118 may include a Global Positioning System (GPS) device. The navigation unit 118 may perform navigation functions. Navigation functions may include, for example, providing navigation instructions, providing a route, providing a current location of the robot 104, and providing date/time information.

The robot 104 may include a network access device 116 that may be coupled to the one or more data processors 112. The network access device 116 may be configured to allow the robot 104 to connect to the personal device 102 to receive management and control information, such as instructions to deliver the mail, notifications, operational data, and other instructions associated with organizing, sorting, shredding and/or delivering mail.

The robot 104 may include one or more sensors 120 that may be coupled to the one or more data processors 112. The one or more sensors 120 may include a capacity sensor, a temperature sensor, a battery sensor, and/or one or more ground sensors. The capacity sensor may detect the amount of storage available or used by the robot 104 for storing mail and/or shredding mail. The temperature sensor may detect the temperature outside the mailbox so that the robot 104 may provide that information to the personal device 102. The battery sensor may detect the amount power remaining to operate the robot 104. The ground sensors may be may be used to navigate the robot 104 among the one or more locations guided by the one or more ground beacons 122.

The robot 104 may include a navigation unit 118 that may obtain a current location of the robot 104. The robot 104 may use the navigation unit 118 to guide the robot 104 among the one or more locations. The one or more location may be inputted by a user on the personal device 102 and obtained by the robot 104. In some implementations, the one or more sensors 120 interact with the one or more ground beacons 122 to guide the robot 104.

Figure 2:
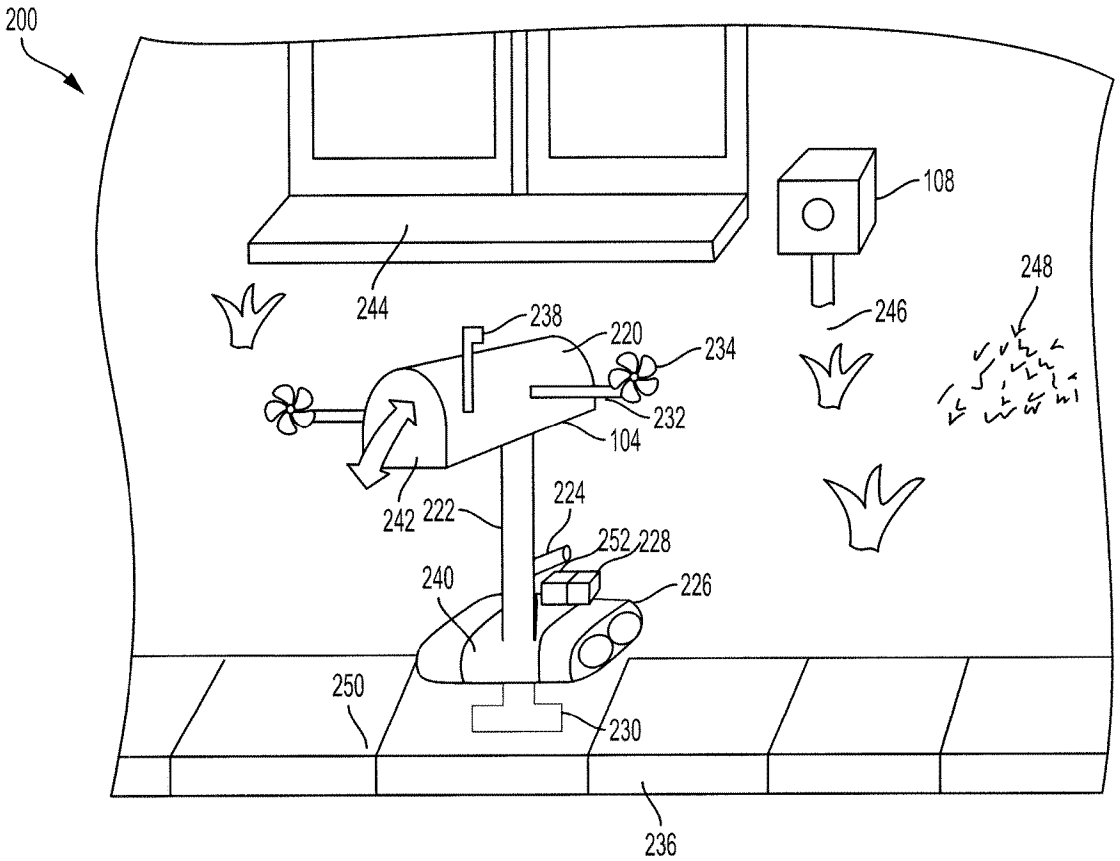
FIG. 2 is an illustration of an example operational environment for the robot according to an aspect of the invention.

FIG. 2 is an illustration of an example operational environment 200 of the robot 104. One or more computers or one or more data processing apparatuses, for example, the one or more data processors 112 or the navigation unit 118 of the automated mailbox system 100 of FIG. 1, appropriately programmed, may operate the robot 104 to sort, shred, and/or deliver mail.

The operational environment 200 includes the robot 104, the receptacle assembly 108, and one or more locations, such as a mail delivery location 250, a home location 246, a mail pickup and/or drop-off location 244, and/or a trash location 248. The mail delivery location 250 is the place where the robot 104 delivers the mail to and receives mail from the mail carrier, such as the curbside. The home location 246 is the place where the robot 104 may connect to the receptacle assembly 108 to charge. The mail pickup and/or drop-off location 244 is the location where the addressee receives the mail or the addresser places the mail into the mailbox 220, e.g., the doorstep of a residence. The mail pickup and/or drop-off location 244 may be the same or different location as the home location 246. The trash location 248 is the location where the robot 104 disposes of shredded junk mail. The junk mail may include solicitations, advertisements, or bulk mail.

The robot 104 includes a mailbox 220 and one or more transportation components 226, e.g., one or more wheels, one or more flight rotors 234, and/or one or more treads. A mailbox is a storage container that holds one or more pieces of mail. The robot 104 may include a base 240, a post 222, a battery 228, a motor 252, an anchor 230 and a receptacle assembly connector 224.

The mailbox 220 may be coupled to a post 222. The mailbox 220 stores one or more pieces of mail and may have one or more bins. The mailbox 220 may have one or more devices to perform sorting, shredding and/or delivery of the one or more pieces of mail. The mailbox 220 has a front door 242 at one end of the mailbox 220 and may have a back door (not shown) at an opposite end of the mailbox 220. The operation of the one or more devices and the one or more doors may be further described in more detail in reference to FIG. 3.

The mailbox 220 may be coupled to a distinct transportation component, such as one or more flight surfaces 232 and one or more flight rotors 234. The flight rotors 234 and mailbox 220 may decouple from other components of the robot 104, such as the post 222 and/or the base 240, and propel through the air. The one or more flight rotors 234 may rotate about an axis to create propulsion to propel the mailbox 220 through the air. The propulsion may be in a direction that is along the perpendicular axis of the mailbox 220.

A mailbox flag 238 may be connected to the mailbox 220. The mailbox flag 238 may be moved between a down position and an up position. The down position, for example, may indicate that there is no mail in the mailbox 220. The up position, for example, may indicate that there is mail in the mailbox 220. The mailbox flag 238 may be configured to turn on or off a letter-sorting device in the mailbox 220. In addition, the mailbox flag 238 may be automatically activated when an unused stamped letter or package is placed in the mailbox 220 and automatically deactivated when the mail carrier removes the unused stamped letter or package from the mailbox 220. The mailbox 220 can also send a notification to the personal device 102 indicating to the user that the stamped letter or package has been taken by the mail carrier.

The mailbox 220 may be coupled to a post 222. The post 222 may be made of wood, metal, plastic, carbon fiber, or any other rigid material. The post 222 may be connected to the bottom surface of the mailbox 220 and extend through the base 240 into the foundation 236. One end of the post 222 may have an anchor 230 that embeds into a cavity of the foundation 236. The anchor 230 may be retractable and/or extendable. That is, the anchor 230 may extend below the base 240 and embed into the foundation 236 or may be drawn upward back into the post 222 and/or the base 240 so that the anchor 230 does not impede movement of the robot 104. When retracted, the anchor 230 may collapse into a shape to be stored in the base 240 and/or the post 222. The anchor 230 may be made of metal, such as steel or iron, or other rigid material. The anchor may be "T" shaped, "X" shaped or any other shape designed to embed in a cavity in the foundation 236. The foundation 236 may be made of concrete, earth, rock, sand or any other medium for placement of a mailbox.

One or more batteries 228 may be coupled to the base 240. The one or more batteries 228 may provide power to operate the one or more devices in the mailbox 220 and/or the motor 252 to move the robot 104 using the one or more transportation components 226. A power source, such as the receptacle assembly 108 or a solar panel, may be connected to the robot 104 to charge the one or more batteries 228. In some implementations, the robot 104 has an electrical cord that connects to the receptacle assembly 108. The one or more batteries 228 supply power to the motor 252 to operate the one or more transportation components 226.

The robot 104 may include one or more transportation components 226 to move among the one or more locations. The transportation components 226 may use one or more treads or one or more wheels connected to the base 240 to move among one or more locations. The transportation component 226 may move in multiple directions. The transportation component 226 may be coupled to the base 240. The base 240 may rotate the transportation components 226 to direct the robot 104 in the different directions. In some implementations, the individual transportation component, such as a wheel, is rotated to direct the robot 104 in the different directions. One or more actuators may be used to rotate the one or more wheels or the base 240. The transportation component 226 may be configured to lock and prevent movement of the one or more wheels or the one or more treads.

Figure 3:
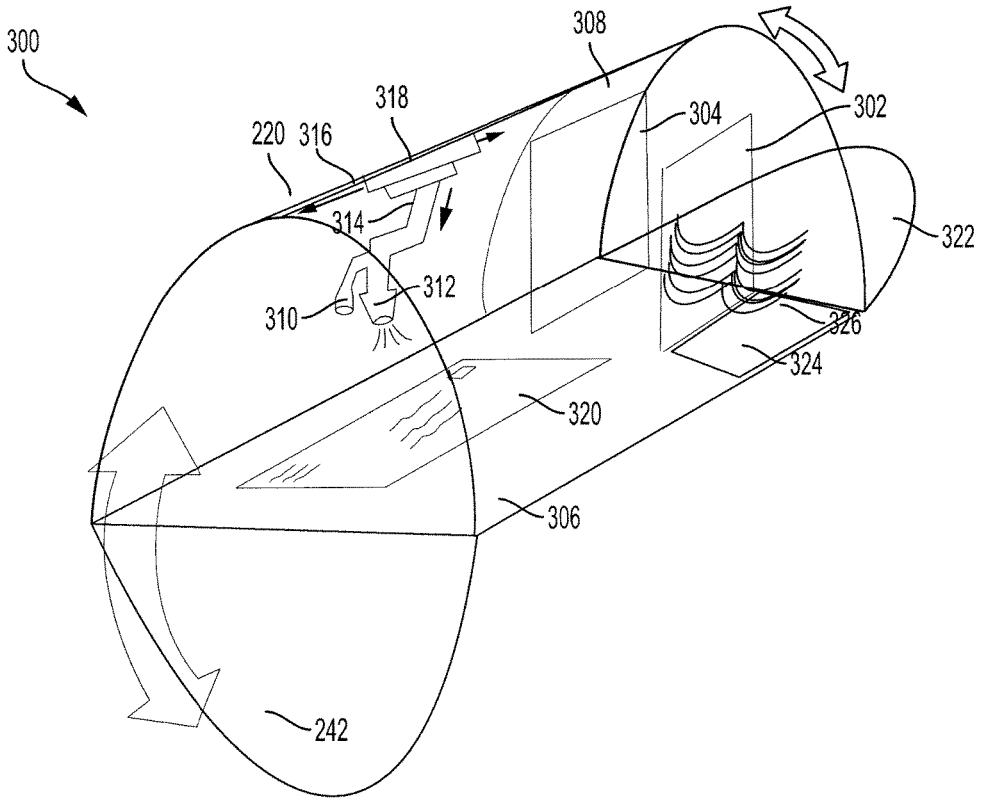
FIG. 3 is an illustration of an example mail sorting and shredding environment within the mailbox according to an aspect of the invention.

FIG. 3 is an illustration of an example mail sorting and shredding environment 300 within the mailbox 220. One or more computers or one or more data processing apparatuses, for example, the one or more data processors 112 of the automated mailbox system 100 of FIG. 1, appropriately programmed, may operate to sort and shred the mail within the mailbox 220.

The mailbox 220 has a front door 242 connected to a front portion 306 of the mailbox 220 and may have a back door 322 connected to a back portion 308 of the mailbox 220. The front door 242 may be at one end of the mailbox 220, and the back door 322 may be at the opposite end of the mailbox 220.

The front door 242 and the back door 322 may move between an open position, a partially open position, and a closed position. When either door is in the open position or the partially open position, one or more pieces of mail may be placed in the mailbox 220. When the front door 242 is in the closed position, there may be no access to the inside of the mailbox 220 from the front portion 306. When the back door 322 is in the closed position, there may be no access to the inside of the mailbox 220 from the back portion 308. The front door 242 and the back door 322 may have a locking mechanism, e.g., a deadbolt, and/or a door biasing apparatus. The locking mechanism is configured to lock the front door 242 and/or the back door 322 in the closed position preventing access to the inside of the mailbox 220. The door biasing apparatus may bias the front door 242 and/or the back door 322 into the closed position when the doors are in the partially open position or the open position.

The front door 242 provides access to the front portion 306. The front portion 306 may form a cavity to create an entrance for one or more pieces of mail 320. Inside the front portion 306, there may be a sorting apparatus 318 that may move back and forth along the longitudinal axis of the mailbox 220 using one or more rails 316 or rollers on the ceiling of the mailbox 220. The sorting apparatus 318 may include one or more cameras 310 and one or more letter-sorting devices 312, such as a suction device, coupled to an arm 314 that may extend and retract the one or more cameras 310 and/or the one or more letter-sorting devices 312 relative to the position of the one or more pieces of mail 320. In some implementations, the one or more cameras 310 and the one or more letter-sorting devices 312 are on different arms. In some implementations, the one or more cameras 310 are on the inside surface of the mailbox 220 and not on an arm.

The one or more cameras 310 may be used to capture images of the one or more pieces of mail 320 to sort. The one or more letter-sorting devices 312 may move the one or more pieces of mail 320 into a position to capture the one or more images and/or move the one or more pieces of mail 320 into one or more bins in the back portion 308.

The back portion 308 may have one or more bins formed using one or more dividers 302 and 304 that segregate a cavity formed within the back portion 308. The one or more dividers 302 and 304 may be vertical dividers or horizontal dividers to create the one or more bins in a vertical configuration or a horizontal configuration, respectively. The one or more bins may be used to store the sorted and/or shredded mail, e.g., a shred bin, or an addressee bin. The shred bin, i.e., the bin storing the mail to be shredded, may include a shredder 326 that is configured to shred junk mail.

The back portion 308 may have a trapdoor 324 in the shred bin that may be configured to move between an open position and a closed position to allow shredded mail to drop into the trash location 248. In some implementations, the shred bin may be in the front portion 306, a side portion, a top portion or a bottom portion, of the mailbox 220.

Figure 4:
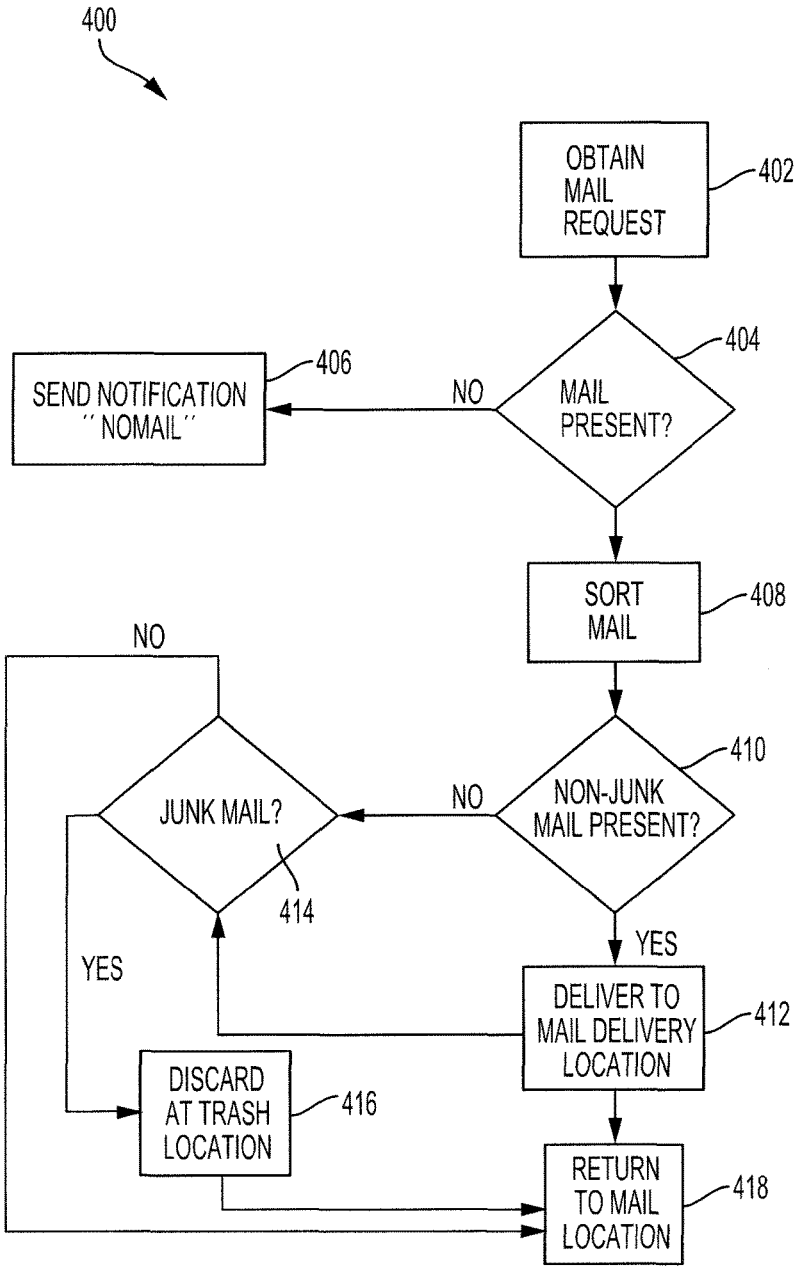
FIG. 4 is a flow diagram of an example process for delivering mail according to an aspect of the invention.

FIG. 4 is a flow diagram of an example process for delivering mail. One or more computers or one or more data processing apparatuses, for example, the one or more data processors 112 or the navigation unit 118 of the robot 104 of the automated mailbox system 100 of FIG. 1, appropriately programmed, may perform the process 400.

The system 100 obtains a mail request (402). The mail request may be a request for the robot 104 to return to the home location 246, return to the mail pickup and drop-off location 244, return to the mail delivery location 250, or lock or unlock the mailbox 220. The mail request may include a date and time and/or a location. If the mail request is a request to return to the home location 246 and/or the mail delivery location 250, the robot 104 travels to the home location 246 and/or the mail delivery location 250, respectively. If the mail request is a request to return to the mail pickup and/or drop-off location 244, the robot 104 performs the sorting functions.

The system 100 may receive a mail request from a personal device 102 through the network 106. The system 100 may obtain the mail request from a schedule. The schedule may be pre-programmed. The system 100 may obtain a current date and time from an internal clock or from the navigation unit 118 using, for example, a GPS device. The system may extract, from the mail request, the delivery date and time and/or delivery location and execute the request when the current date and time is the same as the extracted date and time in the mail request. In some implementations, the mail request may be executed immediately.

The system 100 may determine that the request is a request to return to the mail pickup and/or drop-off location. The system 100 may determine whether the mailbox has mail (404). The system 100 may use the one or more sensors 120 and/or the one or more cameras 310 to determine whether the mailbox has mail. The system 100 may capture one or more images of the inside of the mailbox 220 and send the one or more images to the personal device 102. The system 100 may request confirmation that there is mail in the mailbox 220. The system 100 may receive user input that indicates that there is mail in the mailbox 220.

In some implementations, the mailbox 220 may contain a weight sensor at the bottom surface of the mailbox 220, and if the weight is greater than or equal to a threshold value, the system 100 determines that there is mail in the mailbox 220. In some implementations, a volume sensor at the top of the mailbox (e.g., a camera or ultrasound sensor) may serve a purpose similar to the weight sensor.

If the system 100 determines that there is no mail, the system 100 may send a notification to the personal device 102 that indicates that there is no mail (406). The notification may include an image of the inside of the mailbox 220. The notification may display the image of the inside of the mailbox 220 on the personal device 102 through an application, e.g., mobile device application, or a web browser. In some implementations, the notification may be an audio notification, such as a beep, a chime, a voice notification, or any other user-configurable audio notification.

The system 100 may sort one or more pieces of mail into one or more bins. The system 100 may sort the one or more pieces of mail based on the position of the mailbox flag 238 or the mail request (408). If the mailbox flag 238 is in the up position that may indicate that there is outgoing mail so the sort functionality may be turned off. If the mailbox flag 238 is in the down position that may indicate that there is no outgoing mail so the sort functionality may be turned on. The one or more bins may include a shred bin, an incorrect addressee bin, and/or one or more addressee bins. The system 100 may sort the one or more pieces of mail into the one or more bins based on one or more attributes. The one or more attributes may include the addresser's information, the addressee's information, the colors of the document, and/or one or more markings on the document. For each piece of mail, the system 100 may determine whether the piece of mail is junk mail, an incorrectly addressed mail, or mail to be delivered to an addressee based on the one or more attributes.

Each of the one or more addressee bins may correspond to one or more addressees or persons located at the mail pickup and/or drop-off location. For example, if "John Doe," "Jane Doe," and "James Doe" pickup their mail at the mail pickup and/or drop-off location 244, a bin may be assigned to each person. The assignment of the one or more bins may be user-configurable and may be assigned using the personal device 102. In some implementations, the one or more addressees may be assigned to a single bin. For example, the entire "Doe family" may be assigned to one bin. The number of assignments may be limited only by the number of bins and the number of addressees.

The shred bin is designated for junk mail that is scheduled for shredding and disposal at the trash location 248. The incorrect addressee bin is designated for mail with an addressee or address that does not correspond to the mail pickup and/or drop-off location. The addressees and/or addresses that correspond to the mail pickup and/or drop-off location may be user-configurable and may be configured using the personal device 102. The system 100 analyzes each piece of mail to determine the bin in which the piece of mail belongs which is further described in reference to FIG. 5.

The system 100 may determine whether there is mail in the one or more non-shred bins (410). The system 100 may use one or more sensors, e.g., a weight sensor, to determine if mail is in the one or more non-shred bins. For example, if the weight in one of the non-shred bins is greater than or equal to a threshold value, which may indicate there is mail in the bins. Similarly, a volumetric sensor can determine if there is mail in the one or more non-shred bins.

If there is mail in the one or more non-shred bins, the system 100 delivers the mail to the mail pickup and/or drop-off location 244 (412). The system 100 may obtain the location of the mail pickup and/or drop-off location 244 from one or more configuration settings programmed from the personal device 102. In some implementations, the system 100 may obtain the location of the mail pickup and/or drop-off location 244 from the mail request. In some implementations, the system 100 follows one or more ground beacons 122 to the mail pickup and/or drop-off location 244. The system 100 may receive sensor information from the one or more ground beacons 122 that may guide the robot 104 among the one or more locations. The robot 104 may retract an anchor 230 into the base 240 and use energy from the battery 228 to move the transportation components 226, such as the one or more treads and/or the one or more flight rotors 234, in one or more directions toward the mail pickup and/or drop-off location 244.

The system 100 may determine whether there is junk mail in the shred bin (414). The system 100 may determine that there is junk mail based on the used capacity of the shred bin. The system 100 may detect the used capacity of the junk mail bin based on the weight or volume of the junk mail in the shred bin. If the weight or volume is greater than a threshold amount, the system 100 may determine that there is junk mail.

If there is junk mail in the shred bin, the system 100 transports the junk mail to the trash location, shreds the junk mail, and disposes of the shredded junk mail at the trash location 248 (416). In some implementations, the system 100 may shred the junk mail immediately after the system 100 determines that the mail is junk mail or upon a request from the personal device 102. After the system 100 delivers the mail to the mail pickup and/or drop-off location 244 or the trash location 248, the system 100 may return to the mail delivery location 250 (418). The system 100 may return to the mail delivery location 250 based on user input on the personal device 102 or based on determining that there is no mail in the mailbox 220. The system 100 may determine that there is no mail remaining in the mailbox 220, using, for example, a weight sensor, and determining that the weight of any contents in the mailbox 220 is below a threshold amount. The system 100 may return to the home location 246 if the system 100 determines that the power is low based on a battery sensor.

Figure 5:
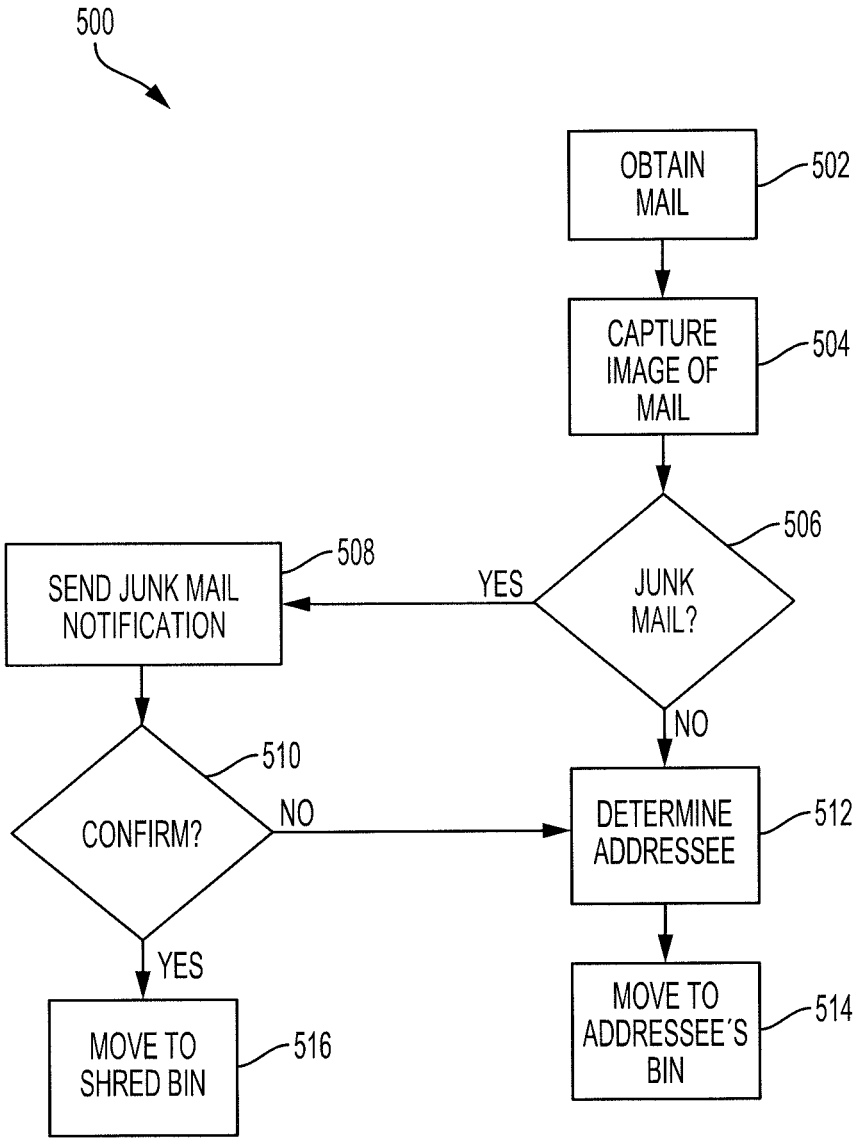
FIG. 5 is a flow diagram of an example process for organizing and sorting mail according to an aspect of the invention.

FIG. 5 is a flow diagram of an example process for sorting and shredding mail. One or more computers or one or more data processing apparatuses, for example, the one or more data processors of the mailbox 220 of FIG. 2, appropriately programmed, may perform the process 500.

The system may obtain mail (502). The system 100 may allow the front door 242 to be placed into an open position by unlocking the locking mechanism of the front door 242. By placing the front door 242 into the open position, an open cavity at a front portion 306 of the mailbox 220 is exposed allowing one or more pieces of mail to be placed into the front portion 306 of the mailbox 220. The system 100 may determine that the mail is incoming mail. That is, the mail is being received by an addressee at the mail pickup and drop off location based on the mail flag 238.

The system 100 may determine whether the obtained mail includes a package. The system 100 may capture an image of the obtained mail within the mailbox 220, and determine if the image is of a package by comparing, for example, the physical dimensions of the mail using one or more sensors to measure the dimensions. The system 100 may alert the personal device 102 that there is a package for pickup or use the letter-sorting device 312 to move the package to a bin so as not to shred or dispose of the package prior to sorting, shredding and delivering of the one or more other pieces of mail.

The system 100 captures one or more images of one or more pieces of mail placed into the mailbox 220 (504). The system 100 may adjust the one or more pieces of mail placed into a position such that one or more cameras may capture the one or more images. The system 100 may use the letter-sorting device 312 to move the one or more pieces of mail from one location to another location or from one position to another position. In some implementations, the one or more cameras 310 and/or the letter-sorting device 312 are coupled to an arm 314 that may extend and retract vertically from a sorting apparatus 318. The arm 314 may rotate using an actuator to allow the one or more cameras 310 to view multiple angles and perspectives of the one or more pieces of mail and to allow the letter-sorting device 312 to move the one or more pieces of mail.

Certain attributes, such as multiple different colors of different intensities, addressee information that does not include an individual's or organization's name, e.g., "Residence of," standardized typeface, and/or markings, such as logos or images, may indicate that the mail is junk mail.

The system 100 may determine whether a piece of mail is junk mail based on the captured image of the piece of mail and one or more attributes (506). The system 100 analyzes a piece of mail for one or more attributes to determine whether the piece of mail is junk mail. The one or more attributes may include the color intensities of the piece of mail, the addressee's information, the addresser's information, the typeface on the piece of mail, the lack of a specific name on the addressee's information, and/or one or more other markings on the piece of mail. The system 100 may use the one or more sensors and/or cameras to analyze the color intensities and typeface on the piece of mail. A highly colorful document may indicate a greater likelihood the piece of mail is junk mail. For example, a grocery advertisement has various objects that have multiple colors, whereas, an addressed manila envelope is plain. Thus, the advertisement is more likely junk mail than the manila envelope.

The system 100 may evaluate the typeface to determine if the piece of mail is junk mail. For example, a handwritten typeface may indicate that the piece of mail is personalized and not mass-mailed. On the other hand, use of a printed font may be an indication that the document was mass-mailed and is junk mail.

The system 100 may detect one or more other markings on the piece of mail, such as an emblem, image, or a logo, or an indication that the piece of mail is bulk mail or solicitation mail, and determine from the one or more other markings that the piece of mail is junk mail.

The system 100 may determine the addressee information and/or the addresser information from the piece of mail by, for example, performing optical character recognition (OCR) on the piece of mail. The system 100 may identify from the addresser information a name and address of the addresser and from the addressee information a name and address of the addressee.

The system 100 may compare the name and/or address of the addresser to a junk mail list, and if the name and/or address of the addresser appear on the junk mail list, the system 100 may identify the piece of mail as junk mail. The junk mail list may be user configurable. That is, an addressee may be added, modified, and/or removed from the list by a user of the personal device 102. In some implementations, the system 100 may automatically add or remove an addresser based on a user confirmation that a document is junk mail when a captured image of the piece of mail is presented to a user on the personal device 102. In some implementations, the system 100 may determine if the addressee is a generic addressee. If the name of the addressee is generic, the system 100 may determine that the piece of mail is junk mail.

In some implementations, each of the one or more attributes may have a weighting factor. The system may determine that the piece of mail is junk mail based on a calculation of a junk mail score, which may be a function of each of the one or more attributes and their weighting factors. If the junk mail score is greater than or equal to a threshold score, the system 100 may determine that the piece of mail is junk mail. The threshold score and weighting factors may be user configurable.

If the system 100 determines that the piece of mail is junk mail, the system 100 may send a notification to the personal device 102 (508). The notification may include the captured image of the piece of mail, and may include a confirmation request. The confirmation request may include one or more user interface elements, such as a button, to receive user input that identifies whether the piece of mail is junk mail, an addressee's mail, and/or mail to an incorrect addressee. In some implementations, the notification may provide additional information, such as the addressee, the addresser, and/or additional captured images of the piece of mail. The additional captured images may be scrolled through by selecting one or more user interface elements, such as one or more buttons.

The system 100 may validate that the mail is junk mail based on a response to the confirmation request (510). If the response confirms that the piece of mail is junk mail, the system 100 moves the piece of mail to the shred bin and may add the addresser to the junk mail list (516). If the response indicates that piece of mail is not junk mail, the system 100 may determine the addressee of the piece of mail.

The system 100 may determine the addressee by scanning or capturing an image of a portion of the document associated with the addressee information (512). The system 100 may perform OCR on the scanned or captured image and extract a name and/or address from the addressee information.

The system 100 may compare the extracted name and/or address to a list of known addressee's for the mail pickup and/or drop-off location 244 and determine whether the addressee is registered to the mail pickup and/or drop-off location 244. An addressee may be registered using the personal device 102. If the addressee is on the list, the system 100 may move the piece of mail to one or more bins associated with the addressee (514). If the addressee is not on the list, the system 100 may move the document to an incorrect addressee bin. In some implementations, there are not individual bins associated with each addressee and/or an incorrect addressee bin, but instead only a shred bin and/or non-shred bin.

Figure 6:
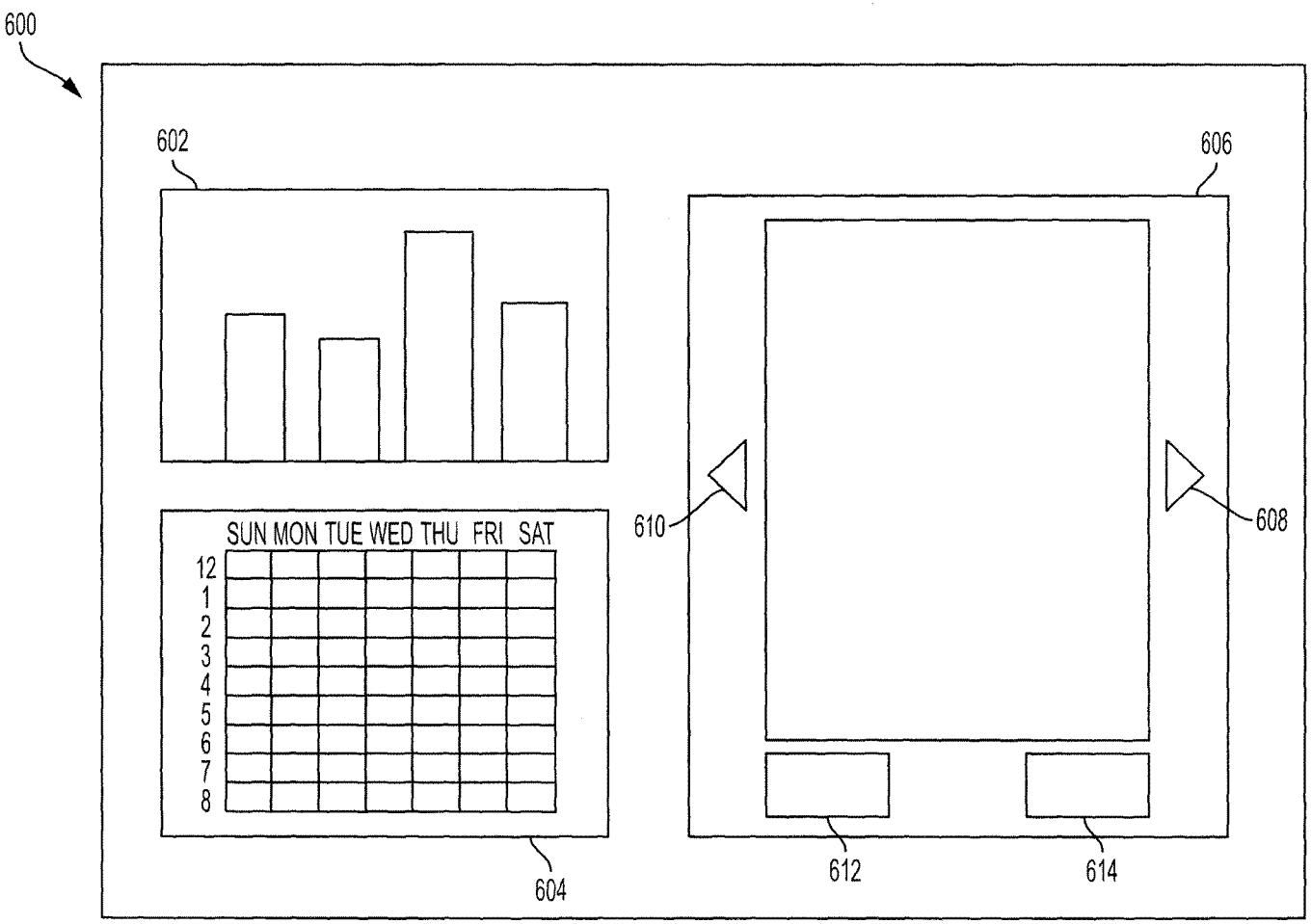
FIG. 6 is an illustration of an example graphical user interface display on a personal device according to an aspect of the invention.

FIG. 6 is an illustration of an example graphical user interface (GUI) display 600 of a personal device 102. One or more computers or one or more data processing apparatuses, for example, the one or more data processors 112 of the automated mailbox system 100 of FIG. 1, appropriately programmed, may implement the graphic user interface display 600 on the personal device 102.

The GUI display 600 may be configured to display notifications, user configurable settings, monitoring information, schedule information, and/or one or more captured images. The GUI display 600 may have one or more display frames, e.g., display frames 602, 604, and 606. The one or more display frames may display the notifications, the user configurable settings, the monitoring information, the schedule information, and/or the one or more captured images. For example, the display frame 602 displays the monitoring information, the display frame 604 displays the schedule information, and the display frame 606 displays a captured image. The display frame, e.g., the display frame 606, may have one or more buttons, e.g., buttons 608 and 610, to scroll through the one or more captured images and/or the one or more displays. For example, a display frame may scroll between different displays of different information, such as the monitoring information, the scheduling information, or the one or more captured images. In another example, the display frame 606 scrolls through different images captured by the one or more cameras. Selection of the button 610 may scroll the display in the display frame 606 to a previous image and the selection of the button 608 may scroll the display in the display frame 606 to the next image. Other buttons, e.g., buttons 612 and 614, may be used to confirm or cancel the shredding of one or more pieces of mail.

The monitoring information may include information describing the capacity of each of the one or more bins inside the mailbox 220 and/or health information of the robot 104. For example, the monitoring information may include a percentage or an amount of the used capacity in the shred bin, a percentage or an amount of the used capacity in the one or more addressees' bins, and/or a percentage or an amount of power remaining in the battery. The schedule information may include information describing the date/time that the robot 104 is at or travels to one of the one or more locations. The health information may include information describing any software or hardware faults.

The GUI display 600 may be configured to receive user input to send to the robot 104. User input may include user configurable settings for setting the threshold capacity before a notification is sent and/or a threshold capacity before mail is delivered to a trash location 248 and/or mail pickup and/or drop-off location 244. User input may include schedule and route information that describes the route, the date and time the robot 104 travels among the one or more locations and/or one or more commands to travel to a location. Other user input may include the confirmation and/or cancelling of one or more determinations, such as a determination to shred a piece of mail, a determination of an addressee for a piece of mail, and/or a determination that a piece of mail is junk mail.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An automated mailbox, comprising:

an enclosure having:

a door that is configured to move between an open position and a closed position, a first portion that is configured to receive a plurality of documents when the door is in the open position and where the plurality of received documents are placed, a second portion that is adjacent to the first portion and that has a plurality of bins for storing the plurality of received documents, the plurality of bins including a first bin that is configured to store at least one document of the plurality of received documents, and a letter sorting device that is configured to sort and move the at least one document from the first portion into the first bin in the second portion; and a transportation component that is connected to the enclosure and configured to move in a plurality of directions.

2. The automated mailbox of claim 1, further comprising:

a power source for providing energy;

a receptacle assembly configured to interface with and provide the energy to charge the power source; and a navigation unit configured to provide navigation information including a current location.

3. The automatic mailbox of claim 1, further comprising at least one of a GPS device or one or more ground beacons to navigate.

4. The automatic mailbox of claim 1, further comprising a post connected to at least one of the enclosure or the transportation component and that vertically extends and retracts and includes an anchor that is configured to secure in a structural member to prevent movement of the automatic mailbox.

5. The automatic mailbox of claim 1, wherein the enclosure includes:

one or more processors configured to:

determine that a first document of the at least one document is of a first type, and cause the letter sorting device to move the first document to the first bin in response to determining that the first document is of the first type.

6. The automatic mailbox of claim 5, wherein the one or more processors is further configured to:

capture, using a camera, an image of the first document; and match one or more features of the first document to one or more attributes of the first type.

7. The automatic mailbox of claim 5, wherein the transportation component is further configured to move among a plurality of locations including moving to a first location of the plurality of locations based on the first document being moved to the first bin.

8. The automatic mailbox of claim 7, wherein the plurality of bins includes a second bin, wherein the one or more processors are further configured to:

determine that a second document of the plurality of documents is of a second type;

move the second document to the second bin for the second type;

shred the second document in the second bin; and wherein the transportation component is further configured to move to a second location to dispose of the shredded second document.

9. A method for sorting and delivering mail, comprising:

obtaining, within a first portion of an enclosure of an automated mailbox at a first location, one or more pieces of mail, the one or more pieces of mail including a piece of mail being of a first type or a second type;

capturing, by a processor using a camera within the enclosure, one or more images of the piece of mail;

determining, by the processor, whether the piece of mail is of the first type or the second type based on the one or more images of the piece of mail; and moving, using a letter sorting device within the enclosure, the piece of mail from the first portion of the enclosure to a first bin in a second portion of the enclosure if the piece of mail is of the first type;

determining, by the processor, that at least one piece of mail is in the first bin; and transporting, using a transportation component connected to the enclosure, the at least one piece of mail from the first location to a second location.

10. The method of claim 9, further comprising moving, using the letter sorting device, the piece of mail from the first portion of the enclosure to a second bin in the second portion of the enclosure if the piece of mail is of the second type.

11. The method of claim 10, further comprising:

determining, by the processor and using the camera, that at least one piece of mail is in the second bin;

shredding, using a shredder, the at least one piece of mail in the second bin; and transporting, using the transportation component, the at least one piece of mail in the second bin to a third location either from the first location or the second location.

12. The method of claim 11, wherein the first type of mail is deliverable mail and the second type of mail is junk mail.

13. The method of claim 9, wherein determining whether the piece of mail is of the first type or the second type further comprises:

identifying, by the processor and using the camera, one or more features of the piece of mail;

comparing, by the processor, the one or more features of the piece of mail to one or more attributes of the first type and one or more attributes of the second type; and determining, by the processor, that the piece of mail is of the first type based on the comparison.

14. The method of claim 13, wherein identifying the one or more features of the first piece of mail includes performing, by the processor, optical character recognition.

15. The method of claim 13, wherein identifying the one or more features of the piece of mail includes analyzing, by the processor, the piece of mail for color or shape attributes.

16. The method of claim 13, wherein the one or more attributes of the first type and the one or more attributes of the second type each have a weighting factor, wherein the weighting factor is user configurable.

17. The method of claim 16, wherein determining that the piece of mail is of the first type is based on the comparison and the weighting factor of each of the one or more attributes of the first type and the one or more attributes of the second type.

18. An automated mailbox robot, comprising:

a base that foil is a foundation for the automated mailbox robot;

a mailbox connected to the base and having:

a door that is configured to move between an open position and a closed position, the mailbox configured to receive a document when the door is in the open position, and a processor configured to determine that the document is of a particular type; and a transportation component that is connected to the base and moves in a plurality of directions among a plurality of locations based on the particular type of the document that is received within the mailbox.

19. The automated mailbox robot of claim 18, wherein the mailbox has a post coupled to the base, wherein the post vertically extends and retracts and includes an anchor that is configured to secure in a structural member to prevent movement of the automated mailbox robot.

* * * * *